US006993997B1

(12) United States Patent
Marro

(10) Patent No.: US 6,993,997 B1
(45) Date of Patent: Feb. 7, 2006

(54) RATCHET WRENCH

(76) Inventor: Richard R. Marro, 7008 Alamosa Way, El Paso, TX (US) 79912

( * ) Notice: Subject to any disclaimer, the term of this patent is extended or adjusted under 35 U.S.C. 154(b) by 61 days.

(21) Appl. No.: 10/968,899

(22) Filed: Oct. 21, 2004

(51) Int. Cl.
*B25B 13/00* (2006.01)

(52) U.S. Cl. ..... 81/59.1; 89/59.39; 192/44

(58) Field of Classification Search ..... 81/59.1, 81/58, 60, 59.39, 63.1; 192/44
See application file for complete search history.

(56) References Cited

U.S. PATENT DOCUMENTS

| | | | | |
|---|---|---|---|---|
| 4,004,666 | A | 1/1977 | Hinojosa | |
| 4,030,581 | A * | 6/1977 | Giometti | 192/16 |
| 4,051,935 | A | 10/1977 | Nakayama | |
| 4,669,339 | A | 6/1987 | Cartwright | |
| 4,987,803 | A * | 1/1991 | Chern | 81/57.39 |
| 5,884,537 | A | 3/1999 | Chen | |
| 5,941,140 | A | 8/1999 | Suksi | |
| 6,044,944 | A * | 4/2000 | Adams et al. | 192/44 |
| 6,047,617 | A | 4/2000 | Chen | |
| 6,055,888 | A * | 5/2000 | Mitchell | 81/59.1 |
| 6,267,027 | B1 | 7/2001 | Mitchell | |
| 6,367,354 | B1 * | 4/2002 | Mitchell | 81/59.1 |
| 6,575,058 | B1 * | 6/2003 | Mitchell | 81/59.1 |

FOREIGN PATENT DOCUMENTS

| | | |
|---|---|---|
| GB | 2041272 | 12/1979 |

* cited by examiner

*Primary Examiner*—Joseph J. Hail, III
*Assistant Examiner*—Alvin J Grant
(74) *Attorney, Agent, or Firm*—Stephen R. Greiner

(57) ABSTRACT

A ratchet wrench including a housing with a handle extending therefrom. A rotor is positioned within an opening in the housing. The rotor includes a crosspiece having a polygonal cross-section and a downwardly extending stem for the selective attachment of a socket. A pair of movable wedges is positioned adjacent each side of the crosspiece. A compressed spring separates the movable wedges of each pair and normally urges the wedges away from one another and into snug engagement with both the housing and the crosspiece. A selector is rotatably fastened to the rotor. The selector includes a disk rotatably fastened to the top of the rotor. A fin extends upwardly from the top of the disk and a plurality of arms extends downwardly from the bottom of the disk with one of the arms being provided for each pair of movable wedges. The arms, by manual rotation of the disk, selectively drive one wedge from each pair of movable wedges from engagement with the housing to permit ratcheting of the wrench.

2 Claims, 2 Drawing Sheets

RATCHET WRENCH

FIELD OF THE INVENTION

The present invention relates generally to tools and, more particularly, to wrenches with clutched handles.

BACKGROUND OF THE INVENTION

Most ratchet wrenches have some play in their ratchet mechanisms. While not always apparent, this play prevents a mechanic from utilizing the full swing of a wrench's handle to turn a nut or bolt. When working in confined areas, such as automobile engine compartments, it may be difficult, if not impossible, to turn a nut or bolt with a conventional ratchet wrench. Unfortunately, it is difficult to determine in advance which areas are too small for a particular ratchet wrench to operate. So, much time and effort can be squandered in the trial and error process to find out.

SUMMARY OF THE INVENTION

In light of the problems associated with the known ratchet wrenches, it is a principal object of the invention to provide an improved ratchet wrench that has minimal, i.e., essentially zero, play in its clutch or ratchet mechanism. It is believed that such a tool will be especially useful for tightening fasteners in confined spaces.

It is another object of the invention to provide a ratchet wrench of the type described that requires minimal instruction to employ. In fact, the wrench is particularly intuitive to use.

It is an object of the invention to provide improved elements and arrangements thereof in a ratchet wrench for the purposes described which is lightweight in construction, inexpensive to manufacture, and dependable in use.

Briefly, the ratchet wrench in accordance with this invention achieves the intended objects by featuring a housing with an outwardly extending handle. A rotor is positioned within the housing. The rotor includes a crosspiece having a square cross-section and a downwardly extending stem for the attachment of a nut- or bolt-turning socket. A pair of movable wedges is positioned adjacent each of the four sides of the crosspiece. A compressed spring normally urges the wedges of each pair away from one another and into engagement with both the housing interior and one side of the crosspiece. A selector has a disk rotatably fastened to the rotor and a fin extending upwardly from the disk for turning the selector. Four arms extend downwardly from the bottom of the disk with one of the arms being provided for each pair of movable wedges. The arms selectively drive one wedge from each pair of movable wedges from engagement with the housing to permit ratcheting of the wrench.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
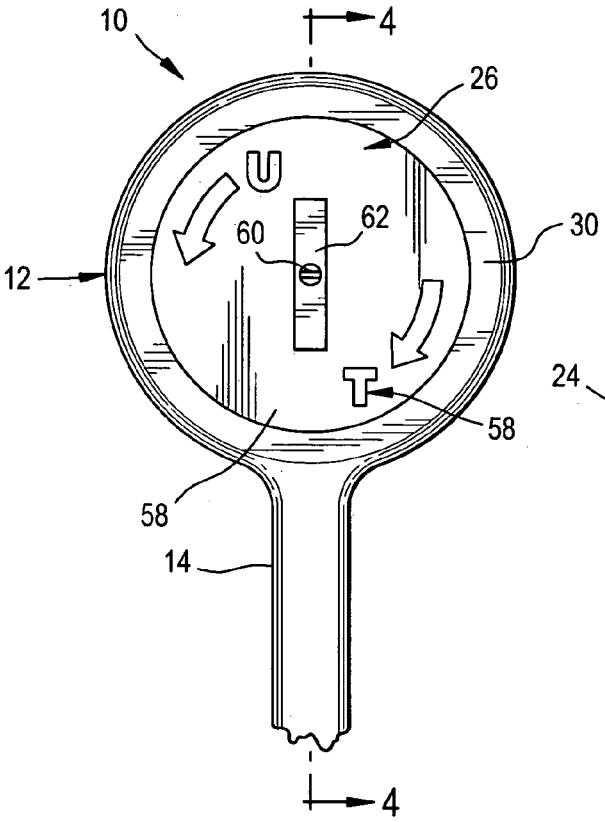
FIG. 1 is a front view of a ratchet wrench in accordance with the present invention with a portion of its handle being broken away.
Figure 3:
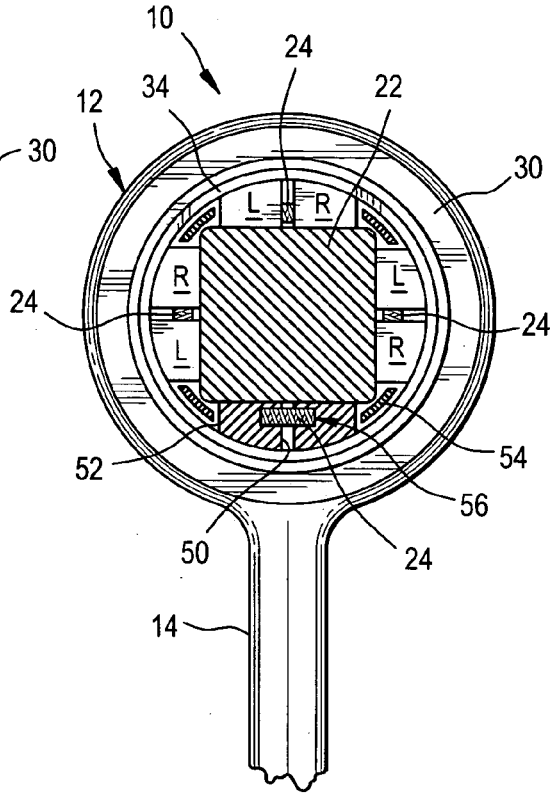
FIG. 3 is a cross-sectional view taken along line 3—3 of FIG. 2.
Figure 2:
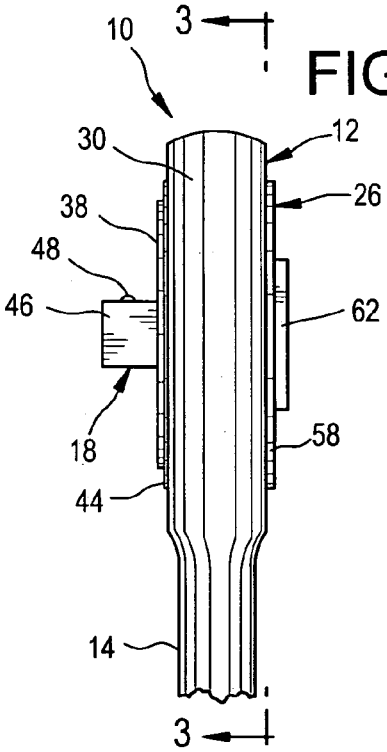
FIG. 2 is a side view of the ratchet wrench of FIG. 1 with a portion of its handle being broken away.
Figure 4:
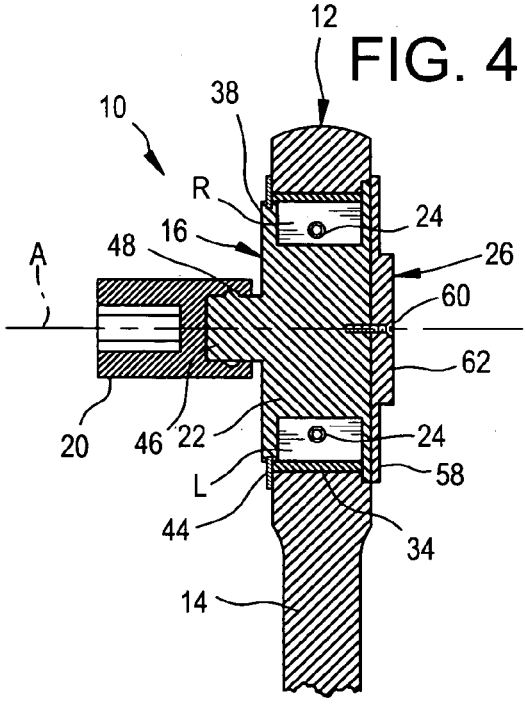
FIG. 4 is a cross-sectional view taken along line 4—4 of FIG. 1.
Figure 5:
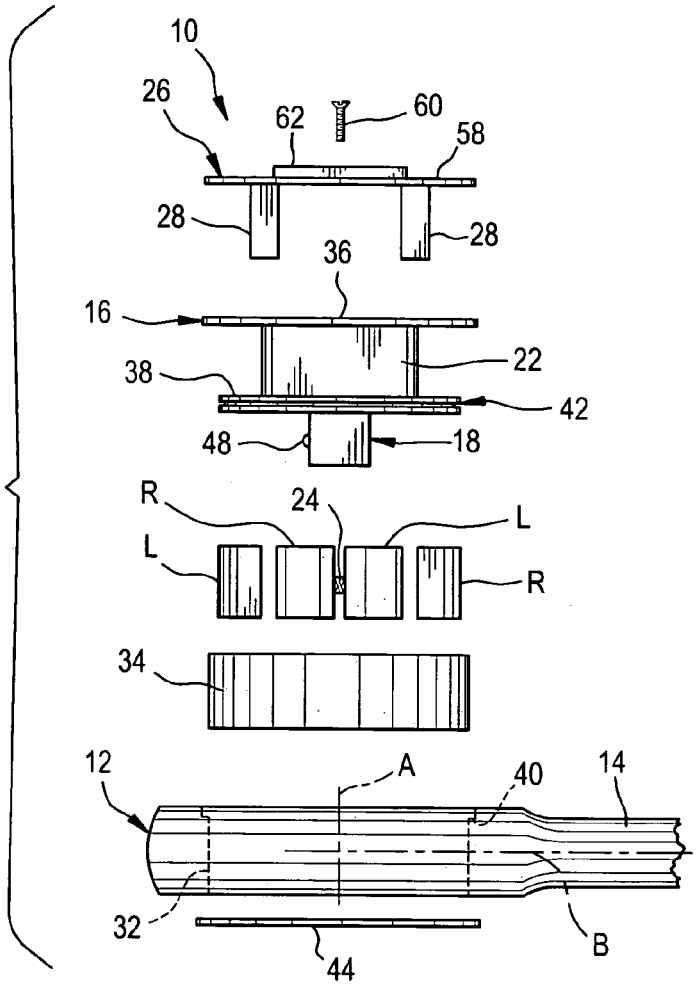
FIG. 5 is an exploded side view of the ratchet wrench with portions of the handle being broken away.
Figure 6:
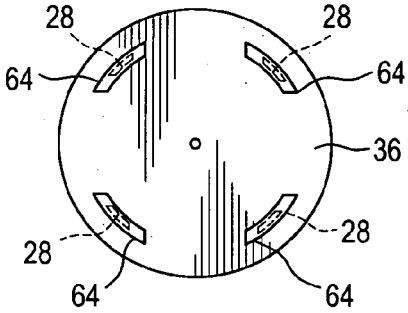
FIG. 6 is a top view of the rotor of the ratchet wrench.

Referring now to the FIGS., a ratchet wrench in accordance with the present invention is shown at 10. Wrench 10 includes a housing 12 with a handle 14 extending therefrom. A rotor 16 is positioned in housing 12 and has a downwardly extending stem 18 for carrying a socket 20. Rotor 16 also has a crosspiece 22 with a square cross section against each side of which is positioned a pair of wedges L and R. Wedges L and R of each pair are separated by a compressed spring 24 that normally urges such away from one another and into engagement with both housing 12 and crosspiece 22. A selector 26 is rotatably fastened to the top of rotor 16 and has a plurality of arms 28 that extend downwardly between adjacent pairs of wedges L and R. The manual rotation of selector 26 drives arms 28 into either wedges L or wedges R so as to disengage such from housing 12 and permit the ratcheted movement of rotor 16 within housing 12.

Housing 12 includes a ring 30 having a circular opening 32 whose center defines a longitudinal axis A. Opening 32 is lined with a protective sleeve 34 formed from a material like that used in the manufacture of automobile brake shoes so that wedges L and R can firmly grip housing 12 during use of wrench 10. Sleeve 34 is press-fit into ring 30 so that it can be replaced when worn.

Handle 14 is integrally formed with ring 30 from a durable material. Handle 14 extends radially outward from ring 30 along an axis B oriented at right angles to axis A of opening 32. Handle 14 can be any length deemed appropriate by a manufacturer with longer lengths, of course, affording greater leverage and shorter ones.

Rotor 16 has a circular top plate 36 and a circular bottom plate 38 joined together by crosspiece 22. As shown, top plate 36 projects into an annular groove 40 at the top of opening 32 through ring 30 to prevent rotor 16 from falling through housing 12. Bottom plate 38, however, has a somewhat smaller diameter than top plate 36 to fit closely against sleeve 34 at the bottom of opening 32. Bottom plate 38 is provided with a shallow channel 42 about its periphery within which is fitted a retaining ring 44 that prevents rotor 16 from being easily lifted from opening 32.

Stem 18 extends downwardly from the center of bottom plate 38. Stem 18 includes a lever arm of 46 of square cross section adapted to be selectively fitted within the top of socket 20 that is adapted to turn a nut or bolt of specific size. A socket retainer 48 projects laterally from one side of lever arm 46 to provide sufficient frictional force to keep socket 20 upon arm 46 in the event that wrench 10 is jarred or bumped.

Wedges L and R are positioned within opening 32 in the annular space between sleeve 34 and crosspiece 22. Each of wedges L and R is about as tall as crosspiece 22 so that it fits closely, yet movably, between plates 36 and 38. The width of each wedge L and R, however, is somewhat less than one-half of the distance from one side of crosspiece 22 to the other to permit movement of each pair of wedges L and R along a side of crosspiece 22. The depth of each wedge L and R varies from a deep inner side 50 to a shallow outer side 52. Neither side 50 or 52 has a depth that is less than the distance from a corner 54 of crosspiece 22 to sleeve 34 so as to prevent jamming of wrench 10.

The outermost surface of each wedge L and R is provided with a radius of curvature matching that of the inside of sleeve 34 for snug engagement therewith. Like sleeve 34, wedges L and R are formed from a material like that used in the manufacture of automobile brake shoes so that they can firmly grip sleeve 34 when wrench 10 is being employed to tighten a fastener.

Springs 24 are fitted within opposed bores 56 provided in the inner sides of wedges L and R. For the sake of drawing convenience, only one spring 24 is shown positioned between each pair of wedges L and R. In the preferred embodiment of wrench 10, a pair of springs 24 would normally be employed between each pair of wedges L and R to ensure that wedges L and R snugly engage sleeve 34 and crosspiece 22 during use of wrench 10. Of course, the number of springs 24 employed within wrench 10 is largely a matter of design choice.

Selector 26 permits a user to adjust wrench 10 so that it can be selectively employed to either tighten or loosen a threaded fastener. Selector 26 includes a disk 58 attached by means of a threaded fastener 60 on axis A to the top of rotor 16. Extending upwardly from the top of disk 58 is a fin 62 that can be grasped to rotate disk 58 either clockwise or counterclockwise. Extending downwardly from the bottom of disk 58 are four arms 28 that, by rotation of disk 58, can be pressed into either all wedges L or all wedges R. In so doing, the wedges L or R pressed by arms 28 are disengaged from sleeve 34 permitting ratcheting of wrench 10.

The provision of indicia 65 upon the top of disk 58 can aid a user in setting wrench 10 for untightening or tightening fasteners. A "U" accompanied by an arrow indicates the direction that disk 58 should be turned for untightening fasteners. A "T" accompanied by an arrow pointing in the opposite direction indicates the direction that disk 58 must be rotated for tightening purposes.

Arcuate slots 64 are provided in top plate 36 of rotor 16 adjacent the corners 54 of crosspiece 22. Slots 64 permit arms 28 of selector 26 to access wedges L and R. By carefully controlling the length of slots 64, they further serve as stops to prevent the over-travel of arms 28 into wedges L and R that could damage wrench 10.

From the foregoing, it will be appreciated that use of wrench 10 is straightforward. To employ wrench 10 to loosen a fastener like a nut or bolt (not shown), a socket 20 of suitable size is first positioned upon stem 18. Next, socket 20 is positioned atop the fastener. Then, disk 58 of selector 26 is rotated so as to press arms 28 against the outer sides 52 of wedges R. Continued rotation of disk 58 in the same direction moves wedges R away from sleeve 34 against the forces of springs 24. Simultaneously, springs 24 drive wedges L into both sleeve 34 and crosspiece 22 with sufficient force to permit rotor 16 and housing 12 to turn together as a handle 14 is moved counterclockwise about axis A thereby loosening the fastener in socket 20 attached to rotor 16. The more torque applied to handle 14, the more securely wedges L engage housing 12 to prevent slipping.

Figure 7:
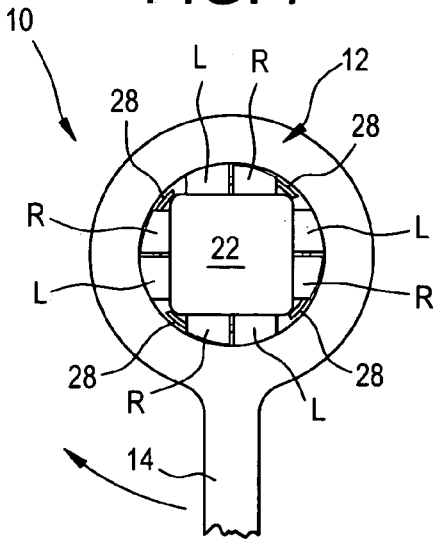
FIG. 7 is a diagrammatic view showing the interior of the ratchet wrench as it would appear while untightening conventional threaded fasteners.

When handle 14 is rotated in a clockwise direction about axis A as illustrated in FIG. 7, the frictional forces between wedges L and sleeve 34 cause wedges L to be moved away from the near corners of crosspiece 22 thereby unlocking housing 12 and rotor 16 without any play. Handle 14 can now be turned clockwise to any point desired by a user without moving rotor 16 so that untightening of a threaded fastener can continue.

Tightening of a threaded fastener proceeds in the same manner as described above with a few exceptions. First, after engaging socket 20 with the threaded fastener, selector 26 is rotated to engage arms 28 with wedges L instead of wedges R and to drive wedges L from engagement with both sleeve 34 and crosspiece 22. Now, springs 24 drive wedges R into both sleeve 34 and crosspiece 22 with sufficient force to permit rotor 16 and housing 12 to turn together as a handle 14 is moved clockwise about axis A thereby tightening the fastener positioned in socket 20 attached to rotor 16.

Figure 8:
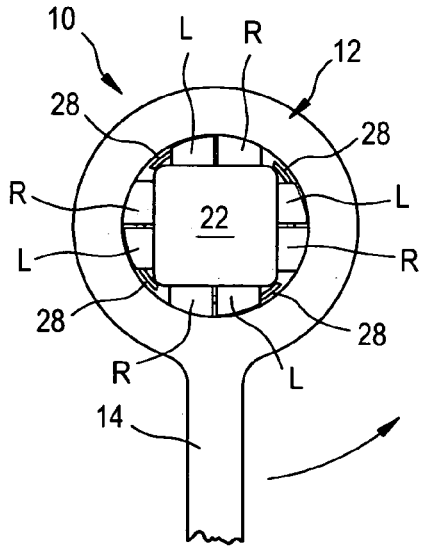
FIG. 8 is a diagrammatic view showing the interior of the ratchet wrench as it would appear while tightening conventional threaded fasteners.

When handle 14 is rotated in a counterclockwise direction about axis A as illustrated in FIG. 8 with the selector 26 positioned as mentioned in the previous paragraph, the frictional forces between wedges R and sleeve 34 cause wedges R to be moved away from the near corners of crosspiece 22 thereby unlocking housing 12 and rotor 16 without any play. Handle 14 can now be turned counterclockwise to any point desired by a user without moving rotor 16 so that tightening of a fastener can continue.

When wrench 10 is no longer needed to either on tighten or tighten a fastener, it can be positioned within a toolbox or cabinet drawer for convenience storage. Wrench 10 is always ready for immediate reuse in tight spaces or otherwise.

While the invention has been described with a high degree of particularity, will be appreciated by those skilled in the art that modifications may be made thereto. For example, the number of sides associated with crosspiece 22 and attendant pairs of wedges L and R can be increased or decreased as desired with an increase perhaps resulting in the ability of wrench 10 to apply greater torque to a threaded fastener. Therefore, it is to be understood that the present invention is not limited to the sole embodiment described above, but encompasses any and all embodiments within the scope of the following claims.

I claim:

1. A ratchet wrench, comprising:

a housing having an opening therein;

a handle extending from said the housing;

a rotor being positioned within said opening in said housing, said rotor including:

a crosspiece having a polygonal cross-section;

a top plate being affixed to the top of said crosspiece;

a bottom plate being affixed to the bottom of said crosspiece; and, a stem extending downwardly from the center of said bottom plate for the selective attachment of a socket;

a pair of movable wedges being positioned adjacent each side of said crosspiece and between said top plate and said bottom plate;

a compressed spring being positioned between each pair of movable wedges for urging said wedges away from one another and into engagement with both said housing and said crosspiece;

a selector being rotatably fastened to said rotor, said selector including:

a disk being positioned atop said top plate and being rotatably fastened thereto;

a fin extending upwardly from the top of said disk; and, a plurality of arms extending downwardly from the bottom of said disk with one of said arms being provided for each said pair of movable wedges, whereby said arms, by rotation of said disk, selectively drive one wedge from each said pair of movable wedges from engagement with said housing to permit ratcheting of said wrench.

2. A ratchet wrench, comprising:

a housing having an opening therein;

a protective sleeve lining said opening;

a handle extending outwardly from said housing;

a rotor being positioned within said opening in said housing, said rotor including:

a crosspiece having a square cross-section;

a top plate being affixed to the top of said crosspiece;

a bottom plate being affixed to the bottom of said crosspiece; and, a stem extending downwardly from the center of said bottom plate for the selective attachment of a socket;

a pair of movable wedges being positioned adjacent each side of said crosspiece and between said top plate and said bottom plate, a first wedge of each said pair of movable wedges preventing said rotor from turning in a counterclockwise direction when engaged with both said sleeve and said crosspiece, and a second wedge of each said pair of movable wedges preventing said rotor from turning in a clockwise direction when engaged with both said sleeve and said crosspiece;

a compressed spring being positioned between said first wedge and said second wedge of each said pair of movable wedges for urging said first wedge and said second wedge of each said pair of movable wedges away from one another and into engagement with both said sleeve and said crosspiece;

a selector being rotatably fastened to said rotor, said selector including:

a disk being positioned upon said top plate and being rotatably fastened thereto;

a fin extending upwardly from the top of said disk for manually rotating said selector; and, a plurality of arms extending downwardly from the bottom of said disk with one of said arms being provided for each said pair of movable wedges for selectively disengaging said first wedge or said second wedge of each said pair of movable wedges from said housing to permit ratcheting of said wrench.

* * * * *